US008997699B2

(12) United States Patent
Roelle et al.

(10) Patent No.: US 8,997,699 B2
(45) Date of Patent: Apr. 7, 2015

(54) LINEAR FREE PISTON COMBUSTION ENGINE WITH INDIRECT WORK EXTRACTION VIA GAS LINKAGE

(75) Inventors: Matthew J. Roelle, Sunnyvale, CA (US); Adam P. Simpson, San Francisco, CA (US)

(73) Assignee: EtaGen, Inc., Menlo Park, CA (US)

( * ) Notice: Subject to any disclaimer, the term of this patent is extended or adjusted under 35 U.S.C. 154(b) by 763 days.

(21) Appl. No.: 13/028,053

(22) Filed: Feb. 15, 2011

(65) Prior Publication Data

US 2012/0204836 A1 Aug. 16, 2012

(51) Int. Cl.

| | |
|---|---|
| ***F02B 71/00*** | (2006.01) |
| ***F02B 71/04*** | (2006.01) |
| ***F02B 75/28*** | (2006.01) |

(52) U.S. Cl.

CPC ..... *F02B 71/04* (2013.01); *F02B 75/285* (2013.01)

(58) Field of Classification Search

USPC ..... 123/46 R, 46 B

See application file for complete search history.

(56) References Cited

U.S. PATENT DOCUMENTS

| | | | | |
|---|---|---|---|---|
| 2,567,042 | A | 9/1951 | Wemp et al. | |
| 2,814,551 | A | 11/1957 | Broeze et al. | |
| 3,170,406 | A * | 2/1965 | Robertson | 417/364 |
| 3,225,617 | A | 12/1965 | Young et al. | |
| 4,154,200 | A | 5/1979 | Jarrett et al. | |
| 4,308,720 | A | 1/1982 | Brandstadter | |
| 4,480,599 | A | 11/1984 | Allais | |
| 4,876,991 | A | 10/1989 | Galitello, Jr. | |
| 4,924,956 | A | 5/1990 | Deng et al. | |
| 5,030,182 | A | 7/1991 | Frost | |
| 5,775,273 | A * | 7/1998 | Beale | 123/46 B |
| 5,832,880 | A | 11/1998 | Dickey | |
| 6,170,442 | B1 | 1/2001 | Beale | |
| 6,199,519 | B1 | 3/2001 | Van Blarigan | |
| 6,276,313 | B1 | 8/2001 | Yang et al. | |

(Continued)

FOREIGN PATENT DOCUMENTS

| | | |
|---|---|---|
| DE | 102007056527 A1 | 5/2009 |
| JP | 2002322946 | 11/2002 |

(Continued)

OTHER PUBLICATIONS

International Search Report and Written Opinion mailed on Mar. 28, 2012 for Application No. PCT/US2011/061145; 12 pages.

(Continued)

*Primary Examiner* — Lindsay Low
*Assistant Examiner* — Omar Morales
(74) *Attorney, Agent, or Firm* — Shvarts & Leiz LLP

(57) ABSTRACT

Various embodiments of the present invention are directed toward a linear free piston combustion engine with indirect work extraction via gas linkage, comprising: a cylinder with two opposed free pistons disposed therein that form a combustion section in a center of the cylinder, each free piston comprising a front face facing the combustion section and a back face facing the opposite direction; two opposed extractor pistons disposed in their own cylinders at opposite ends of the free piston cylinder, each extractor piston comprising a front face facing the combustion section and a back face facing the opposite direction; and two gas linkages, each gas linkage comprising a volume sealed between the back face of a free piston and the front face of an extractor piston; wherein each extractor piston is connected to a rotary electromagnetic machine.

43 Claims, 7 Drawing Sheets

Two-free-Piston , Two Extractor-Piston, Single-Crank Two-Stroke-Embodiment

(56) References Cited

U.S. PATENT DOCUMENTS

| | | | | |
|---|---|---|---|---|
| 6,314,924 | B1 | 11/2001 | Berlinger | |
| 6,374,924 | B1 | 4/2002 | Hanton et al. | |
| 6,415,745 | B1 | 7/2002 | Hellen et al. | |
| 6,443,104 | B1 | 9/2002 | Simescu et al. | |
| 6,532,916 | B2 | 3/2003 | Kerrebrock | |
| 6,541,875 | B1 | 4/2003 | Berlinger et al. | |
| 6,863,507 | B1 | 3/2005 | Schaeffer et al. | |
| 6,945,202 | B2 | 9/2005 | Kaneko et al. | |
| 7,082,909 | B2 | 8/2006 | Graf et al. | |
| 7,104,227 | B2 | 9/2006 | Roberts | |
| 7,258,085 | B2 | 8/2007 | Niiyama et al. | |
| 7,469,664 | B2 | 12/2008 | Hofbauer et al. | |
| 7,622,814 | B2 | 11/2009 | Hyde et al. | |
| 7,640,910 | B2 | 1/2010 | Lemke et al. | |
| 7,845,317 | B2 | 12/2010 | Max et al. | |
| 8,040,011 | B2 | 10/2011 | Mueller et al. | |
| 2005/0081804 | A1 | 4/2005 | Graf et al. | |
| 2005/0257757 | A1 * | 11/2005 | Kemper et al. | 123/46 E |
| 2005/0284427 | A1 | 12/2005 | Barth | |
| 2006/0124083 | A1 | 6/2006 | Niiyama et al. | |
| 2007/0169476 | A1 | 7/2007 | Wood | |
| 2007/0215093 | A1 | 9/2007 | Lemke et al. | |
| 2008/0036312 | A1 | 2/2008 | Max et al. | |
| 2008/0271711 | A1 | 11/2008 | Cheeseman | |
| 2009/0031991 | A1 | 2/2009 | Lindgarde | |
| 2009/0125211 | A1 | 5/2009 | Akihisa et al. | |
| 2009/0199821 | A1 | 8/2009 | Marchetti | |
| 2009/0308345 | A1 | 12/2009 | Van den Brink | |
| 2010/0109343 | A1 | 5/2010 | Lemke et al. | |

FOREIGN PATENT DOCUMENTS

| | | | |
|---|---|---|---|
| JP | 2003343202 | | 12/2003 |
| JP | 2008223657 | | 9/2008 |
| JP | 2009216100 | | 9/2009 |
| WO | 2010118738 | A2 | 10/2010 |
| WO | WO 2010118738 | A3 * | 10/2010 |

OTHER PUBLICATIONS

International Search Report and Written Opinion mailed on Apr. 18, 2012 for Application No. PCT/US2011/066214; 16 pages.

R. Mikalsen; "A Review of Free-Piston Engine History and Application;" Applied Thermal Engineering 27 (2007) pp. 2339-2352.

Jeffrey G. Schreiber; "Development Considerations on the Free-Piston Stirling Power Convertor for Use in Space," NASA/TM May 2007—214805.

Peter Van Blarigan; "Free-Piston Engine; Transportation Energy Center Center;" FY 2009 DOE Vehicle Technologies Program Annual Merit Review; May 19, 2009.

Seon-Young Kim; "Specific Power Estimations for Free-Piston Stirling Engines;" American Institute of Aeronautics & Astronautics, Jun. 2006; pp. 1-8.

Peter Van-Blarigan; "Advanced Internal Combustion Engine Research," DOE Hydrogen Program Review NREL-CP-570-28890 (2000); pp. 1-19.

International Preliminary Report on Patentability for Application No. PCT/US2011/066214, issued Aug. 21, 2013.

* cited by examiner

Diagram illustrating the architecture of conventional engines and issues that limit them from going to high compression ratios.

Common free-piston configurations.

Integrated Linear Electromagnetic Machine Configuration for Direct Conversion of Kinetic Energy Electrical Energy.

Separate Linear Electromagnetic Machine Configuration for Direct Conversion of Kinetic Energy to Electrical Energy.

Gas Compression With Expansion Turbine for Indirect Conversion of Kinetic Energy to Electrical Energy.

Comparison Between Experimental Data from Prototype at Standford University and the Ideal Otto Cycle Efficiency Limit. Model Assumption: Premixed, Stoichiometric, Ideal Gas Propane and Air Including Variable Properties, Dissociated Products, and Equilibrium During Expansion Two-Free-Piston,Two-Extractor-Piston, Two-Crank, Two-Stroke-Embodimant Two Stroke Operation of Two-Free-Piston, Two-Extractor-Piston, Two-Crank Embodiment Four Stroke Operation of Two-Free-Piston, Two-Extractor-Piston, Two-Crank Embodiment Two-free-Piston , Two Extractor-Piston, Single-Crank
Two-Stroke-Embodiment Two-free-Piston , Two Extractor-Piston, Two-LEM, Two-Stroke-Embodiment Single-free-Piston , Single Extractor-Piston, Single-Crank, Two-Stroke-Embodiment

LINEAR FREE PISTON COMBUSTION ENGINE WITH INDIRECT WORK EXTRACTION VIA GAS LINKAGE

FIELD OF THE INVENTION

The present invention relates to a linear free piston combustion engine with indirect work extraction via a gas linkage.

DESCRIPTION OF THE RELATED ART

Linear free piston combustion engines have two main benefits that enable the production of electricity at higher efficiencies than conventional, slider-crank, reciprocating engines: 1) decoupling of pistons from mechanical linkages for work extraction, and 2) shorter amount of time spent at and near top dead center (TDC). Decoupling the pistons from mechanical linkages enables the pistons to experience higher pressures, and therefore forces, than conventional engines because conventional engines are limited by mechanical stresses in the connecting rods and crankshaft. Going to higher pressures prior to combustion (i.e., higher compression ratios) is beneficial because it increases the theoretical efficiency of engines. Decoupling also enables longer strokes, and variable piston dynamics that are not as well matched to a mechanical linkage. Spending less time at and near TDC reduces the time spent at the highest temperatures and therefore the time for heat transfer to occur.

It is difficult to reach high compression/expansion ratios (above 30) in conventional, slider-crank, reciprocating engines ("conventional engines") because of their inherent architecture. A diagram illustrating the architecture of conventional engines and issues that limit them from going to high compression ratios, is shown in FIG. 1 (prior art). Typical IC engines have bore-to-stroke ratios between 0.5-1.2 and compression ratios between 8-24 (Heywood, 1988). As an engine's compression ratio is increased while maintaining the same bore-to-stroke ratio, the surface-to-volume ratio at TDC increases, the temperature increases, and the pressure increases. This has three major consequences: 1) heat transfer from the combustion chamber increases, 2) combustion phasing becomes difficult, and 3) friction and mechanical losses increase. Heat transfer increases because the thermal boundary layer becomes a larger fraction of the overall volume. In other words, the aspect ratio at TDC gets smaller, wherein the aspect ratio is defined as the ratio of the bore diameter to the length of the combustion chamber. Combustion phasing and achieving complete combustion is difficult because of the small volume realized at TDC. Increased combustion chamber pressure directly translates to increased forces. These large forces can overload both the mechanical linkages within the engine (e.g., piston pin, piston rod, crank shaft) causing mechanical failure and the pressure-energized rings causing increased friction, wear, and/or failure.

Conventional engines use the slider-crank mechanism to reciprocate the piston inside a cylinder with a rotating crankshaft. The piston position profile is dictated by the crankshaft position, connecting rod and crankshaft geometry, and mechanism kinematics. Rather than freely accelerating based on pressure and inertial forces, a piston connected to a slider crank mechanism accelerates at a rate primarily determined by the rotational speed of the crank shaft. The kinematic acceleration of the slider-crank piston is less than that of a free piston driven by the same pressure and inertial forces. Thus, a kinematically restricted, slider-crank piston has a lower acceleration at and near TDC than a free piston. As a result, a slider-crank piston spends more time at the locations in a cycle when the temperatures are at their highest in the combustion chamber during a cycle.

The main challenge associated with linear free piston engines is efficiently converting the kinetic energy of the pistons to mechanical work and/or electrical energy. FIG. 2 (prior art) illustrates three common configurations of linear free piston combustion engines. The existing solutions for converting the kinetic energy of free pistons in linear free piston combustion engines to electrical energy can be broken down in to two methods: 1) direct and 2) indirect. Direct methods involve the use of a linear electromagnetic machine and indirect methods involve the use of transfer fluid and a rotary machine.

There are two main types of configurations for linear electromagnetic machines (LEMs) when used in conjunction with linear free piston combustion engines. The first is wherein the translator (or "rotor") of the LEM is integrated into the free pistons and the stator is either integrated into the cylinder or is outside of the cylinder. A diagram of an integrated linear electromagnetic machine configuration for direct conversion of kinetic energy to electrical energy is shown in FIG. 3 (prior art). The main shortcomings of this configuration are temperature control of the moving armature and magnetic losses between the translator and stator (e.g., iron losses, hysteretic losses). Temperature control of the translator is required because the magnetic flux of magnets is inversely proportional to temperature, and magnets lose their magnetism at temperatures above the Curie temperature. Therefore, it is necessary to maintain the free piston at temperatures well below the Curie temperature of the magnets integrated into the free piston, and, in general, it is desirable to maintain the translator at temperatures as low as possible. This is difficult to achieve in an engine, especially when high compression ratio operation is desired (because the peak combustion temperature increases with compression ratio). Magnetic losses between the translator and stator are caused by the thickness of the cylinder wall and the "air gap" between the mover and cylinder wall. Magnetic losses are inversely proportional to the thickness of the cylinder and air gap. The thickness of the cylinder wall at the location of the stator is a function of the pressures that the wall must contain at that location. It is desirable to have the smallest air gap and thinnest cylinder wall as possible. This is difficult to achieve in practice, especially with high compression ratio operation due to high pressures and long strokes.

The second configuration for LEMs is wherein the translator is mechanically linked to the free piston, but located outside of the cylinder. A diagram of a separate linear electromagnetic machine configuration for direct conversion of kinetic energy to electrical energy is shown in FIG. 4 (prior art). This configuration remedies the issues that make temperature control difficult, however at the expense of adding mass to the free piston and equipment and length to the system. Mass is added to the free piston in order to support the translator outside of the cylinder. The piston rod requires some type of linear bearing in order to ensure linear motion and support the rod/translator against bending (due to gravity and axial forces). Since the LEM is located outside of the combustion section, the length of the engine is at least double that of an integrated design. All of these additions add cost and complexity to the system.

The second pre-existing method for extracting work from a linear free piston combustion engine involves indirectly converting the kinetic energy of the free pistons to electrical energy via a transfer fluid and an expansion turbine. A diagram illustrating one embodiment of gas compression with expansion turbine for indirect conversion of kinetic energy to electrical energy is shown in FIG. 5 (prior art). The transfer fluid can be either a liquid or a gas. The main shortcomings of this solution are the low efficiencies and high capital costs of expansion turbines compared to reciprocating solutions, especially at scales below 10 MW.

Several free piston engines have been proposed in the research and patent literature. Of the many proposed free piston engines, several are known to have been physically implemented. The report by Mikalsen and Roskilly describes the free piston engines at West Virginia University, Sandia National Laboratory, and the Royal Institute of Technology in Sweden. Mikalsen, R., & Roskilly, A. (2007), A review of free piston engine history and applications, Applied Thermal Engineering, Volume 27, Issues 14-15, October 2007, Pages 2339-2352. Other research efforts are reportedly ongoing at the Czech Technical University, http://vvww.Iceprojectorg/en/, INNAS BV in the Netherlands, http://www.innas.com/, and Pempek Systems in Australia, http://www.freepistonpower.com/. All of the known, physically implemented free piston engines, except the engine by INNAS, directly convert the kinetic energy of the free piston, or free pistons, to electrical energy using a linear electromagnetic machine. The INNAS engine is a hydraulic pump. All of the generators except the prototype at Sandia National Laboratory (Aichlmayr, H., & Van Blarigan, P. (2009). Modeling and experimental characterization of permanent magnet linear alternator for free piston engine applications. *Proceedings of ES*2009.) and the prototype developed by OPOC (International Patent Application No. PCT/2003/078835) have single piston, dual combustion chambers with the LEM around the center of main cylinder. The Sandia and OPOC engines have two piston single combustion chamber configurations with two LEMs around the main cylinder outside of the center combustion section.

BRIEF SUMMARY OF EMBODIMENTS OF THE INVENTION

Various embodiments of the present invention provide a linear free piston combustion engine with indirect work extraction via a gas linkage.

One embodiment of the invention is directed toward a linear free piston combustion engine with indirect work extraction via gas linkage, comprising: a cylinder with two opposed free pistons disposed therein that form a combustion section in a center of the cylinder, each free piston comprising a front face facing the combustion section and a back face facing the opposite direction; two opposed extractor pistons disposed in their own cylinders at opposite ends of the free piston cylinder, each extractor piston comprising a front face facing the combustion section and a back face facing the opposite direction; and two gas linkages, each gas linkage comprising a volume sealed between the back face of a free piston and the front face of an extractor piston; wherein each extractor piston is connected to a rotary electromagnetic machine.

In the above-described engine, each extractor piston is connected to a crankshaft of a rotary electromagnetic machine using a connecting rod. In addition, each gas linkage translates force on the front face of the free piston to the front face of the extractor piston, and wherein each gas linkage translates force on the front face of the extractor piston to the front face of the free piston. The force on the front face of an extractor piston is directly converted into rotary motion, which is then converted to electrical energy through the rotary electromagnetic machine. By way of non-limiting example, the rotary electromagnetic machine may comprise a permanent magnet machine, induction machine, switched reluctance machine, or a combination thereof.

In operation, the gas linkage acts a gas spring translating forces between two moving pistons without dictating a specific axial separation or a specific volumetric separation. In some embodiments, the engine may further comprise a device for directly or indirectly applying a force to the free pistons in order to adjust piston velocity and phasing to selected values. The engine may operate using a two-stroke piston cycle including a power stroke and a compression stroke, with an expansion ratio greater than the compression ratio, wherein combustion occurs after a compression stroke when the velocities of the free pistons are at or near zero. Alternatively, the engine may operate using a four-stroke piston cycle including a power stroke, an exhaust stroke, an intake stroke, and a compression stroke, with an expansion ratio greater than the compression ratio, wherein combustion occurs after a compression stroke when the velocities of the free pistons are at or near zero.

A further embodiment of the invention is directed toward a free piston combustion engine with indirect work extraction via gas linkage, comprising: a cylinder with curved ends with two opposed free pistons disposed therein that form a combustion section in a center of the cylinder, each free piston comprising a front face facing the combustion section and a back face facing the opposite direction; two opposed extractor pistons, each extractor piston disposed in its own cylinder at opposite ends of the free piston cylinder, each extractor piston comprising a front face facing the combustion section and a back face facing the opposite direction; and two gas linkages, each gas linkage comprising a volume sealed between the back face of a free piston and the front face of an extractor piston; wherein each extractor piston is connected to a single rotary electromagnetic machine. Each extractor piston is mechanically connected to a crankshaft of the rotary electromagnetic using a connecting rod.

Another embodiment of the invention is directed toward a linear free piston combustion engine with indirect work extraction via gas linkage, comprising: a cylinder with two opposed free pistons disposed therein that form a combustion section in a center of the cylinder, each free piston comprising a front face facing the combustion section and a back face facing the opposite direction; two opposed extractor pistons disposed in their own cylinders at opposite ends of the free piston cylinder, each extractor piston comprising a front face facing the combustion section and a back face facing the opposite direction; and two gas linkages, each gas linkage comprising a volume sealed between the back face of a free piston and the front face of an extractor piston; wherein each extractor piston is connected to a linear electromagnetic machine that convert kinetic energy of the extractor piston to electrical energy. The linear electromagnetic machine may comprise a stator and a translator, wherein the extractor piston includes a piston rod that slides along bearings and is attached to the translator. The linear electromagnetic machine is configured to directly convert electrical energy into kinetic energy of the piston assembly for providing compression work during a compression stroke. By way of non-limiting example, the linear electromagnetic machine may comprise a permanent magnet machine, induction machine, switched reluctance machine, or a combination thereof.

Additional embodiments of the invention are directed toward a linear free piston combustion engine with indirect work extraction via gas linkage, comprising: a cylinder having a combustion section located at a closed end of the cylinder; a free piston disposed within the cylinder, the free piston comprising a front face facing the combustion section and a back face facing the opposite direction; an extractor piston disposed in its own cylinder at an end of the cylinder opposite the closed end, the extractor piston comprising a front face facing the combustion section and a back face facing the opposite direction; and a gas linkage comprising a volume sealed between the back face of the free piston and the front face of the extractor piston; wherein the extractor piston is connected to a rotary electromagnetic machine.

Yet further embodiments of the invention are directed toward a linear free piston combustion engine with indirect work extraction via gas linkage, comprising: a cylinder having a combustion section located at a closed end of the cylinder; a free piston disposed within the cylinder, the free piston comprising a front face facing the combustion section and a back face facing the opposite direction; an extractor piston disposed in its own cylinder at an end of the cylinder opposite the closed end, the extractor piston comprising a front face facing the combustion section and a back face facing the opposite direction; and a gas linkage comprising a volume sealed between the back face of the free piston and the front face of the extractor piston; wherein the extractor piston is connected to a linear electromagnetic machine.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The invention disclosed herein provides a means to efficiently convert the kinetic energy of free pistons in a linear free piston combustion engine to electricity, while allowing for large and variable compression and expansion ratios and a short amount of time spent at and near TDC.

Figure 1:
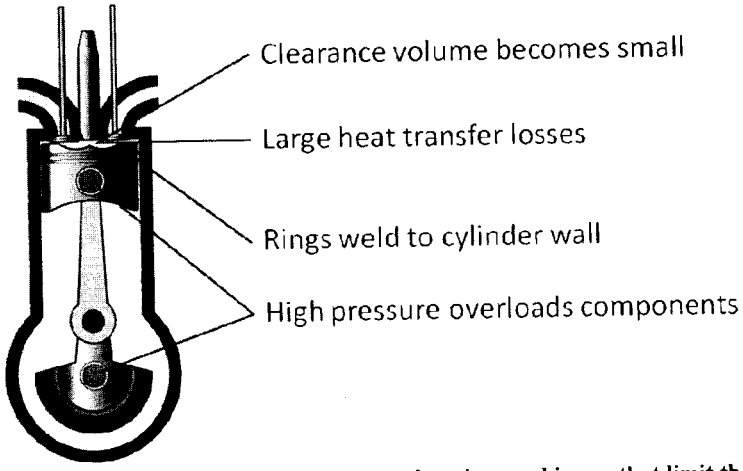
FIG. 1 (prior art)
FIG. 1 (prior art) is a diagram illustrating the architecture of conventional engines and issues that limit them from going to high compression ratios.
Figure 2:
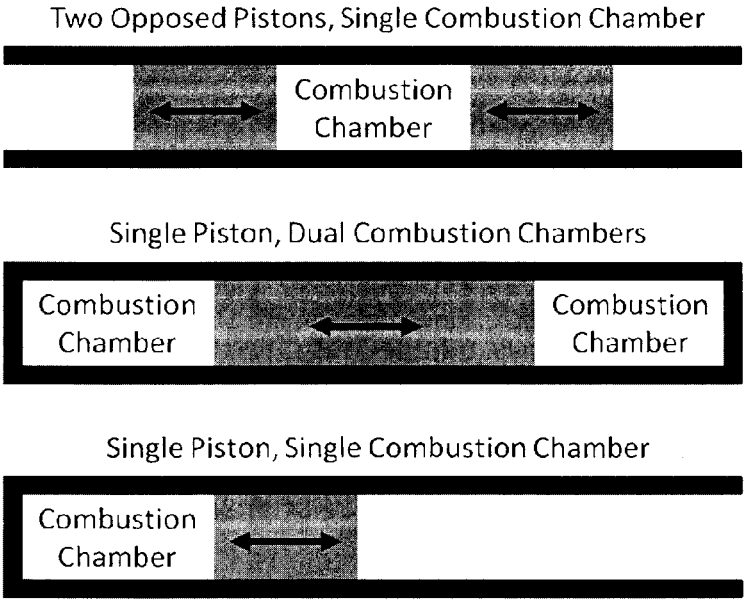
FIG. 2 (prior art)
FIG. 2 (prior art) illustrates three common configurations of linear free piston combustion engines.
Figure 3:
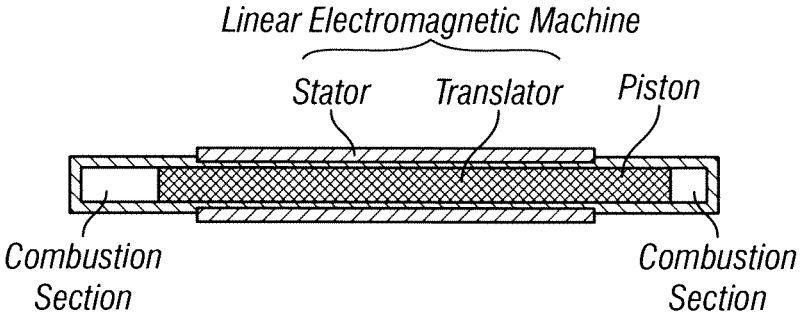
FIG. 3 (Prior Art)
FIG. 3 (prior art) is a diagram of an integrated linear electromagnetic machine configuration for direct conversion of kinetic energy to electrical energy.
Figure 4:
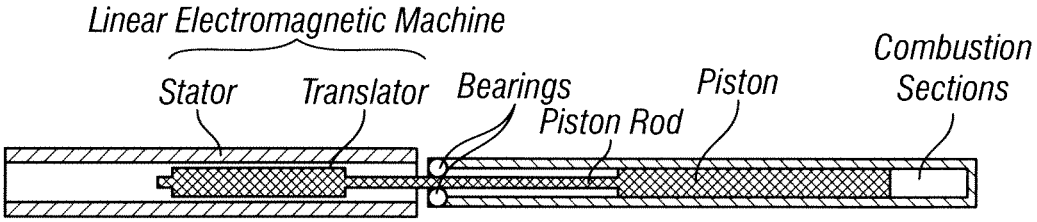
FIG. 4 (Prior Art)
FIG. 4 (prior art) is a diagram of a separate linear electromagnetic machine configuration for direct conversion of kinetic energy to electrical energy.
Figure 5:
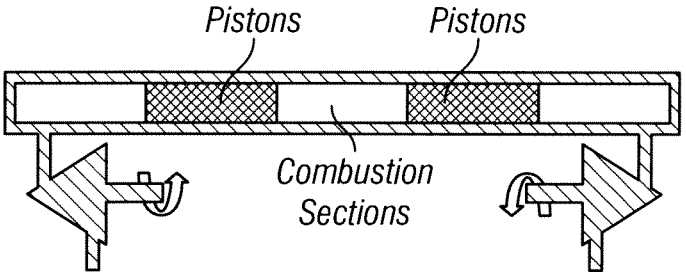
FIG. 5 (Prior Art)
FIG. 5 (prior art) is a diagram illustrating one embodiment of gas compression with expansion turbine for indirect conversion of kinetic energy to electrical energy.
Figure 6:
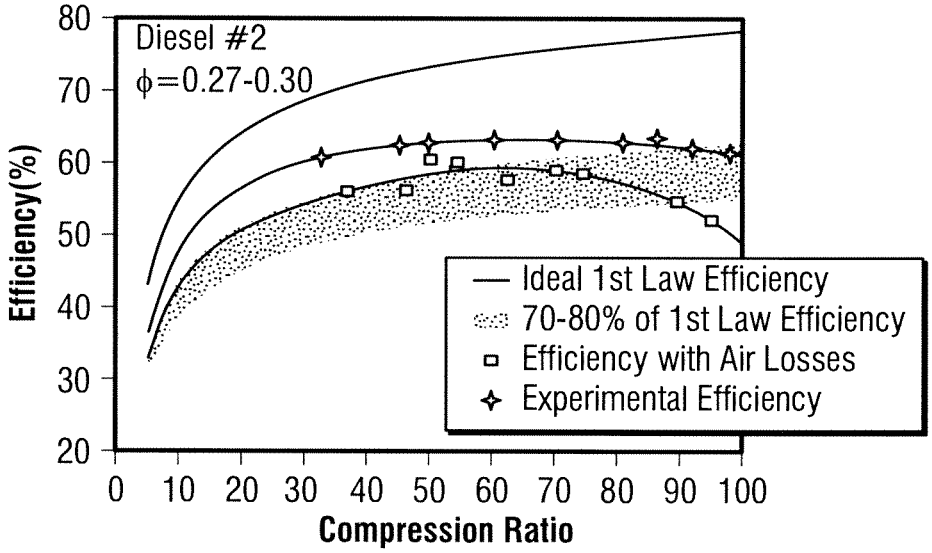
FIG. 6 is a diagram illustrating a comparison between experimental data and the ideal Otto cycle efficiency limit.

The invention can be broken down into two components: 1) chemical energy conversion and 2) work extraction. A single-shot, single-piston, prototype has been built and operated at Stanford University. This prototype demonstrates concept feasibility and achieves indicated-work efficiencies of 60%. FIG. 6 is a diagram illustrating a plot of some experimental results showing a comparison between experimental data from prototype at Stanford University and the ideal Otto cycle efficiency limit. This prototype demonstrates an ability to convert fuel energy to indicated work at very high efficiency by going to high compression ratios. It does not convert the kinetic energy of the piston to work or electricity. The work extraction component of the invention is in the modeling and prototype stages.

Figure 7:
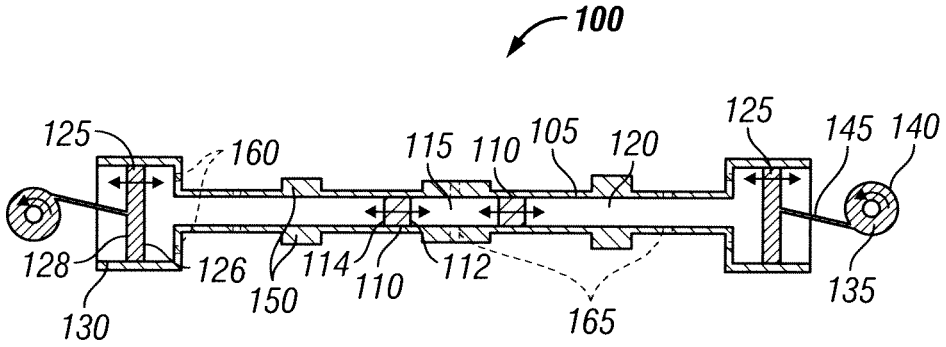
FIG. 7 is a diagram illustrating a two-free piston, two-extractor piston, two-crank, two-stroke engine, in accordance with the principles of the invention.

The following description of the invention is based on a two-free piston, two-extractor piston, two-crank, two-stroke embodiment shown in FIG. 7. Other embodiments and their differing physical and operating characteristics are discussed thereafter. All of the embodiments are free piston, internal combustion engines that indirectly convert the chemical energy in a fuel into electrical energy via an electromagnetic machine through a gas linkage. As used herein, the term "fuel" refers to matter that reacts with an oxidizer. Fuels include, but are not limited to: hydrocarbon fuels such as natural gas, biogas, gasoline, diesel, and biodiesel; alcohol fuels such as ethanol, methanol, and butanol; and mixtures of any of the above. The engines are suitable for stationary power generation and portable power generation (e.g., for use in vehicles).

FIG. 7 illustrates one embodiment of the two-free piston, two-extractor piston, two-crank, two-stroke engine 100. En particular, the engine comprises one cylinder 105 with two opposed free pistons 110 that form a combustion section (or chamber) 115 in the center of the cylinder 105 (i.e., a two opposed pistons, single combustion chamber configuration). Locating the combustion section 115 in the center of the engine 100 has the effect of balancing the combustion forces. Each free piston 110 comprises a front face 112 (combustion side), back face 114 (gas linkage side), and piston seals. The free pistons 110 are free to move within the cylinder 105. The volume on the back face of each free piston 110 is referred to herein as the gas linkage 120. Specifically, each gas linkage 120 is sealed between the back face 114 of the free piston 110 and another piston referred to herein as an extractor piston 125. The extractor pistons 125 are located in their own cylinders 130 that need not have the same diameter as the free piston cylinder 105. Each extractor piston 125 includes a front face 126, back face 128 and piston seals. In the illustrated embodiment, each extractor piston 125 is connected to a crank shaft 135 with a fly wheel 140 via connecting rods 145. The crank shaft 135 is part of a rotary electromagnetic machine (i.e., a generator).

With further reference to FIG. 7, the gas linkage 120 translates the force on the front faces 112 of the free pistons 110 to the front faces 126 of the extractor pistons 125 and vice-versa, with some factor of force multiplication based on the relative area of the two faces. The force on the front faces 126 of the extractor pistons 125 is directly converted into rotary motion, which is then converted to electrical energy through the rotary electromagnetic machine. By way of example, the rotary electromagnetic machine can be a permanent magnet machine, induction machine, switched reluctance machine, or some combination of the three. The gas linkage 120 essentially acts a "gas spring" with pneumatic advantages, translating forces between two moving pistons without dictating a specific axial separation (e.g. a mechanical linkage) or a specific volumetric separation (e.g. a hydraulic linkage). Located on the combustion cylinder 105 is a device 150 to directly or indirectly apply a force to the free pistons 110 in order to adjust piston velocity and phasing to desired values. The device 150 includes a controller to direct the force application as well as other aspects of the system behavior.

The distances traveled by the free pistons 110 and extractors-pistons 125 (i.e., the piston strokes) are not restricted to match one another, as in the case of a mechanical linkage. Further, the profiles followed by each set of pistons (free and extractor) are not restricted to linear functions of one another, as in the case of mechanical or hydraulic linkages. The free pistons 110 can have a stroke length that is significantly longer than conventional engines and can be varied such that the geometric expansion ratio is greater than the compression ratio for a given cycle. As used herein, the term "stroke length" refers to the distance traveled by the pistons between top dead center (TDC) and bottom dead center (BDC). For two-piston embodiment, the stroke is the sum of the distances traveled by each piston between TDC and BDC. For single-piston embodiments the stroke is the distance traveled by the piston between TDC and BDC. The extractor piston strokes are set by the geometry of the connecting rods and crank shafts.

The compressibility of the gas in the gas linkage 120 allows the extractor piston 125 to follow a slider-crank kinematic profile and the free piston 110 to follow a typical free piston profile where very little time is spent at its apex. Further, the diameter of the extractor pistons 125 can be larger, the same as, or smaller than the diameter of the free pistons 110. Utilizing extractor pistons 125 having a larger diameter (as shown in FIG. 7) is preferred when it is desired to have a large compression ratio in the combustor 115 because the peak pressure in the gas linkage 120 will be lower than the peak pressure in the combustion section 115, which minimizes mechanical and frictional losses during work extraction. Embodiments of this invention essentially decouple the combustion section 115 from the work extraction pistons 125 through the gas linkage 120, which provides the benefits associated with free piston architectures while avoiding the difficulties associated with direct work extraction from free piston engines.

With continued reference to FIG. 7, the cylinder 105 has various ports for exchanging matter (solid, liquid, gas, or plasma) with the surroundings. As used herein, the term "port" includes any opening or set of openings (e.g., a porous material) which allow matter exchange between the inside of the cylinder and its surroundings. Additionally, as used herein, the term "surroundings" refers to the area outside of the cylinder, including but not limited to the immediate environment, auxiliary piping, or auxiliary equipment. The number and types of ports in cylinder 105 depends on the engine configuration, injection strategy, and piston cycle (e.g., two- or four-stroke piston cycles). As used herein, the term "piston cycle" refers to any series of piston movements which begin and end with the piston in substantially the same configuration. One common example is a four-stroke piston cycle, which comprises an intake stroke, a compression stroke, a power (expansion) stroke, and an exhaust stroke. Additional alternate strokes may form part of a piston cycle as described throughout this disclosure.

For the two-piston, two-stroke embodiment of FIG. 7, there are ports 160 for the removal of exhaust gases, the intake of air and/or air/fuel mixtures, as well as ports 165 for the control of the gas linkage gases, and for injectors. As used herein, the term "injector" refers to a device for controllably transferring fluid (gas or liquid) into another medium (gas or liquid). These ports 160, 165 may be, but need not be, opened and closed via valves. As used herein, the term "valve" refers to any actuated flow controller or other actuated mechanism for selectively passing matter through an opening, including but not limited to ball valves, plug valves, butterfly valves, choke valves, check valves, gate valves, leaf valves, piston valves, poppet valves, rotary valves, slide valves, solenoid valves, 2-way valves, or 3-way valves. Valves may be actuated by a method, including but not limited to mechanical, electrical, magnetic, camshaft-driven, hydraulic, or pneumatic means. In various embodiments, ports are required for the removal exhaust gases and the control of gas linkage gases. If direct injection is the desired ignition strategy, then injector ports and air intake ports may also be provided. If premixed compression ignition or premixed spark ignition is the desired combustion strategy, then air/fuel intake ports may also be provided. If a hybrid premixed/direct injection strategy with compression ignition and/or spark ignition is the desired combustion strategy, then injector ports and air/fuel intake ports may also be provided. In the various engine configurations described herein, exhaust gas from a previous cycle can be mixed with the intake air or air/fuel mixture for a proceeding cycle. This process it is called exhaust gas recirculation (EGR) and can be utilized to moderate combustion timing and peak temperatures.

Although the embodiment of FIG. 7 operates using a two-stroke piston cycle, other embodiments of the invention can operate using a four-stroke piston cycle, as described hereinbelow with respect to FIG. 9.

Figure 8:
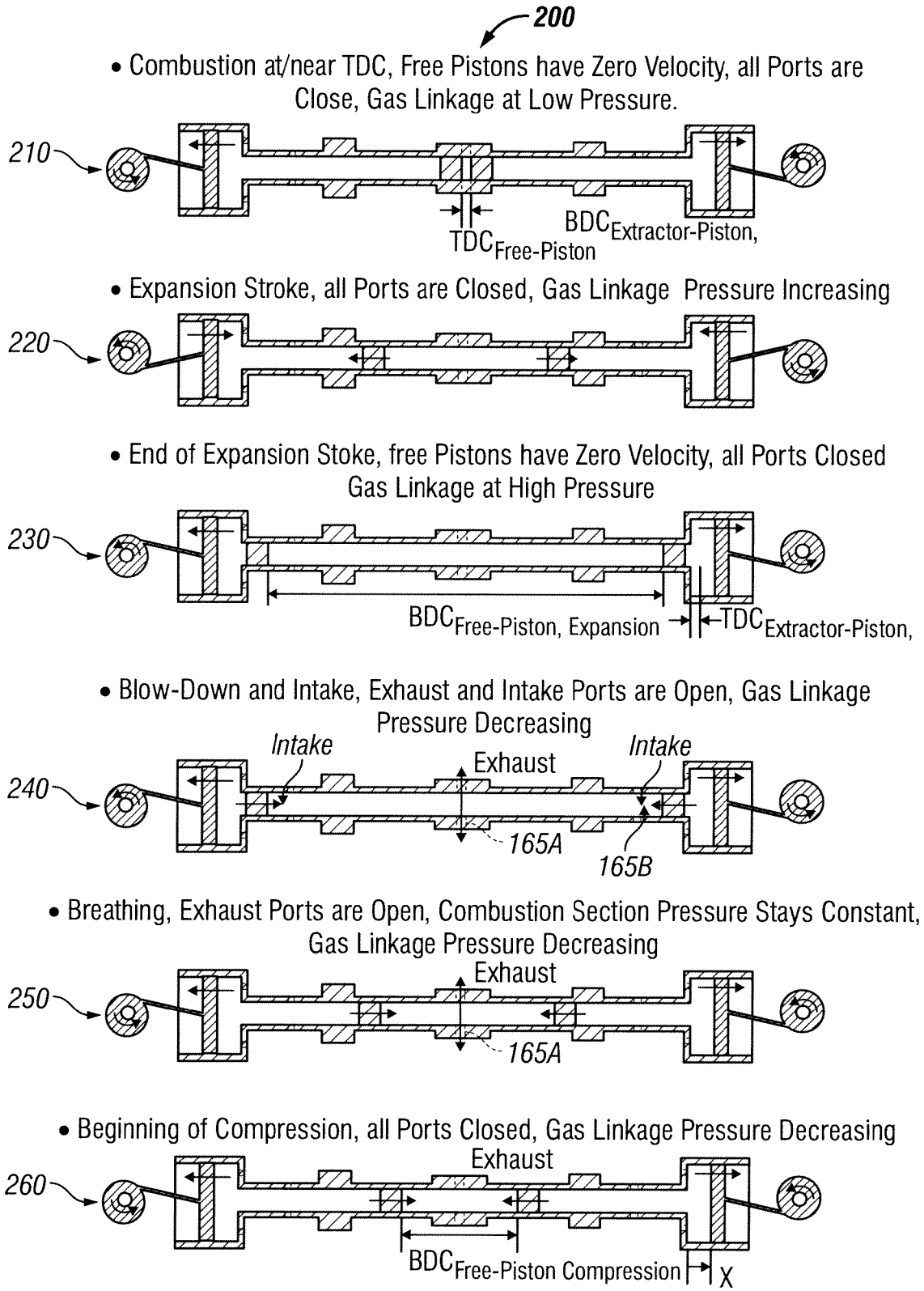
FIG. 8 is a diagram illustrating the two-stroke piston cycle with an expansion ratio greater than the compression ratio, wherein the exhaust valve remains open after the intake valve closes, in accordance with the principles of the invention.

FIG. 8 is a diagram illustrating the two-stroke piston cycle 200 with an expansion ratio greater than the compression ratio, wherein the exhaust valve remains open after the intake valve closes. A two-stroke piston cycle 200 is characterized as having a power (expansion) stroke and a compression stroke. The engine 100 exhausts combustion products and intakes air or an air/fuel mixture or an air/fuel/combustion products mixture near BDC between the power and compression strokes (this process may be referred to as "blow-down", "intake", and "breathing").

With reference to FIGS. 7 and 8, combustion 210 occurs after the compression stroke 260 when the velocities of the free pistons 110 are at or near zero. The points at which the velocities of the free pistons 110 are equal to zero after compression mark their TDC positions for that cycle. Combustion causes an increase in the temperature and pressure within the combustion section 115, which forces the free pistons 110 outward. During the power stroke 220, the pressure in the gas linkage 120 increases. The free pistons 110 continue to move outward until the pressure in the gas linkage 120 increases to the point at which the free pistons reach zero velocity (i.e., at the end 230 of the power stroke). The points at which the velocities of the free pistons are equal to zero after the power stroke 220 mark their expansion-BDC positions for that cycle. At or near the expansion-BDC point, the exhaust and intake ports are opened to allow blow-down and intake 240 to occur. The actuation of the exhaust and intake ports 165A, 165B may occur at the same or different times.

At the expansion-BDC positions, the pressures in the gas linkages 120 are greater than the pressure in the combustion section 115. This causes the free pistons 110 to move inward. As the free pistons 110 move inward, exhaust gases are removed through ports 165A in the center of the combustion section 115 and intake gases are transferred into the combustion section 115 through ports 165B near the expansion-BDC positions. The intake ports 165B are located such that a sufficient amount of air and/or air/fuel mixture can be transferred to the combustion section 115 before the front faces of the free pistons 110 reach the port 165. Intake continues until the intake ports 165B are closed. The exhaust valves may close before, at the same time as, or after the intake ports 165B close.

FIG. 8 illustrates a scenario wherein the exhaust valve remains open after the intake valve closes. As the free pistons 110 move inward, combustion products continue to be removed from the combustion section 115 in a process called "breathing" 250. The pressure in the combustion section 115 can decrease, remain constant, or increase during breathing 250, depending on the velocity of the pistons 110 and size of exhaust ports 165B. The exhaust ports 165A are closed when the free pistons 110 reach positions that will provide the desired compression ratio. The positions of the free pistons 110 when the exhaust ports 165A close mark their compression-BDC positions. Following the closing of the exhaust valves, the free pistons 110 continue to move inward, causing the pressure in the combustion section to increase. Compression 260 occurs until the pistons 110 reach zero velocity, which marks their TDC positions. Combustion 210 occurs at or near TDC and the next "cycle" begins.

Work is extracted from the engine 100 through the extractor pistons 125. In this embodiment, each extractor piston 125 is connected to a crank shaft 135 having a flywheel 140. The flywheel 140 enables the crank shaft 135 to rotate at constant speed, but is not required. The crank shaft 135 can be connected to a rotary mechanical electrical machine to convert the mechanical work to electrical energy. The extractor pistons 125 can otherwise be connected to a linear electromagnetic machine to directly convert their kinetic energy to electrical energy, as discussed below. The free pistons 110 and extractor pistons 125 are phased such that the indicated work in the combustion section 115 is equal to the sum of the indicated work in the gas linkage 120 for a given engine geometry for each cycle. This occurs when the following equation is satisfied for each piston cycle:

$$(\int PdV)_{combination\ section} = \Sigma \int P_{gas\ linkage} A_{extractor\ piston}\, dx_{extractor\ piston},$$

where P is gas pressure in the respective sections, V is volume of the combustion section, A is area of the extractor piston, and x is axial position of the extractor piston (as shown in FIG. 8).

Optimal phasing is maintained and controlled through a direct or indirect application of force to the free piston 110, fuel amount, combustion product exhaust amount, fresh air induction amount, and/or through the exchange of gas to and from the gas linkage 120. The system may directly apply force to the free pistons 110 via physical contact and/or indirectly apply force via electromagnetic communication. Force may be applied at multiple points along the cylinder 105. Gas exchange with the gas linkage 120 may occur at various points within a cycle. The controller 150 may adjust the force application, fuel amount, and/or gas exchange to achieve appropriate work extraction, efficiency and safety.

FIG. 8 shows one port configuration for breathing in which the intake ports 165B are in front of both pistons near BDC and the exhaust ports 165A are near TDC. There are various possible port configurations, such as, but not limited to, having the exhaust ports 165A in front of one piston near BDC and the intake ports 165B in front of the other piston near BDC—allowing for what is called uni-flow scavenging, or uni-flow breathing. The opening and closing of the intake and exhaust ports 165A, 165B are independently controlled. The location of the exhaust ports and intake ports 165A, 165B can be chosen such that a range of compression ratios and/or expansion ratios are possible. The times in a cycle when the exhaust ports and intake ports 165A, 165B are activated (opened and closed) can be adjusted during and/or between cycles to vary the compression ratio and/or expansion ratio and/or the amount of combustion product retained in the combustion section 115 at the beginning of a compression stroke. Retaining combustion gases in the combustion section 115 is called residual gas trapping (RGT) and can be utilized to moderate combustion timing and peak temperatures.

During the piston cycle, gas could potentially transfer past the free pistons 110 between the combustion section 115 and gas linkage 120. This gas transfer is referred to as "blow-by". Blow-by gas could contain air and/or fuel and/or combustion products. The engine 100 is designed to manage blow-by gas by having at least two ports 165B in each gas linkage 120, one port for removing driver gas and the other for providing make-up driver gas. The removal and intake of gas from the gas linkage 120 are independently controlled and occur in such a way to minimize losses and maximize efficiency. FIG. 8 does not illustrate the transfer of gas-linkage gas, only the ports 165B. One strategy for exchanging driver gas is to remove gas-linkage gas at some point during the expansion stroke and intake make-up gas-linkage gas at some point during the compression stroke.

The removal and intake of gas-linkage gas could occur in the reverse order of strokes or during the same stroke. Removed gas-linkage gas can be used as part of the intake for the combustion section 115 during a proceeding combustion cycle. The amount of gas in the gas linkage 120 can be adjusted to vary the compression ratio and/or expansion ratio. As used herein, the "expansion ratio" is the ratio of the volume of the combustion section 115 when the pistons 110 have zero velocity after the power stroke to the volume of the combustion section 115 when the pistons 110 have zero velocity after the compression stroke. Additionally, the "compression ratio" is the ratio of the volume of the combustion section 115 when the pressure within the combustion section 115 begins to increase to the ratio of the volume of the combustion section 115 when the pistons 110 have zero velocity after the compression stroke.

Combustion ignition can be achieved via compression ignition and/or spark ignition. Fuel can be directly injected into the combustion chamber 115 via fuel injectors ("direct injection") and/or mixed with air prior and/or during air intake ("premixed injection"). The engine 100 can operate with lean, stoichiometric, or rich combustion using liquid and/or gaseous fuels. Combustion is optimally controlled by moderating (e.g., cooling) the temperature of the gas within the combustion section 115 prior to combustion. Temperature control can be achieved by pre-cooling the combustion section intake gas and/or cooling the gas within the combustion section 115 during the compression stroke. Optimal combustion occurs when the combustion section 115 reaches the volume at which the thermal efficiency of the engine 100 is maximized. This volume is called optimal volume. The optimal volume can occur before or after TDC is reached. Depending on the combustion strategy (ignition and injection strategy), the combustion section intake gas could be air, an air/fuel mixture, or an air/fuel/combustion products mixture (where the combustion products are from EGR and/or recycled gas-linkage gas), and the gas within the combustion section 115 could be air, an air/fuel mixture, or an air/fuel/combustion products mixture (where the combustion products are from EGR and/or RGT and/or the recycled driver gas).

When compression ignition is the desired ignition strategy, optimal combustion is achieve by moderating the temperature of the gas within the combustion section 115 such that it reaches its auto-ignition temperature at the optimal volume. When spark ignition is the desired ignition strategy, optimal combustion is achieved by moderating the temperature of the gas within the combustion section 115 such that it remains below its auto-ignition temperature before a spark fires. The spark is externally controlled to fire at the optimal volume. The combustion section 115 intake gas can be pre-cooled by means of a refrigeration cycle. As used herein, the term "refrigeration cycle" refers to any thermodynamic cycle that indirectly cools a medium (gas or liquid) by making another medium hotter and/or by directly cooling a medium via expansion. The gas within the combustion section 115 can be cooled during a compression stroke by injecting a liquid into the combustion section 115 which then vaporizes. The liquid can be water and/or another liquid such as, but not limited to, a fuel or a refrigerant. The liquid can be cooled prior to injection into the combustion section 115.

For a given engine geometry and exhaust and intake port locations, the power output from the engine 100 can be varied from cycle to cycle by varying the air/fuel ratio and/or the amount of combustion products in the combustion section 115 prior to combustion and/or the compression ratio and/or the expansion ratio. For a given air/fuel ratio in a cycle, the peak combustion temperature can be controlled by varying the amount of combustion products from a previous cycle that are present in the combustion section gas prior to combustion. Combustion products in the combustion section gas prior to combustion can come from EGR and/or RGT and/or recycling driver gas. Piston synchronization is achieved through a control strategy that uses information about the piston positions, piston velocities, combustion section composition, and cylinder pressures, to adjust the forces provided by the direct and/or indirect free piston controllers and/or gas linkage operating characteristics.

The embodiment described with respect to FIGS. 7 and 8 only includes one unit—defined as cylinders/free pistons/gas linkages/extractor pistons configuration—referred to as "the engine". However, as would be appreciated by those of skill in the art, many units could be placed in parallel, which can collectively be referred to as "the engine". In other words, the invention is meant to be modular such that two or more engine modules can be arranged to operate in parallel to enable the scales of the engine to be increased as needed by the end user. Not all units need be the same size or operate under the same conditions (e.g., frequency, stoichiometry, or breathing). When the units are operated in parallel, there exists the potential for integration between the engines, such as, but not limited to, gas exchange between the units and/or connection to crankshafts from other units.

The free piston architecture allows for large and variable compression and expansion ratios while maintaining sufficiently large volume at TDC to minimize heat transfer and achieve adequate combustion. An inherent benefit of the free piston architecture is that the pistons 110 spend less time at and near TDC than they would if they were mechanically linked directly to a crank shaft (i.e., in a conventional slider-crank engine architecture). The less time spent at and near TDC helps to minimize heat transfer because less time is spent at the highest temperatures. Furthermore, since the work extraction pistons 125 are decoupled from the free pistons 110, the peak pressures that the extractor pistons 125 experience are less than the peak pressure the free pistons 110 experience, which reduces the mechanical and frictional losses experienced by the extractor pistons 125 compared to the losses in a conventional engine. Together, the large and variable compression and expansion ratios, the sufficiently large volume at TDC, the indirect conversion of kinetic energy to electrical energy through the gas linkage 120, the inherently short time spent at and near TDC, and the ability to control combustion, enable the engine to achieve thermal efficiencies greater than 50%.

The losses within the engine 100 include: combustion losses, heat transfer losses, electrical conversion losses, frictional losses, and blow-by losses. Combustion losses are minimized by performing combustion at high internal energy states, which is achieved by having the ability to reach high compression ratios while moderating combustion section temperatures. Heat transfer losses are minimized by having a sufficiently large volume at or near when combustion occurs such that the thermal boundary layer is a small fraction of the volume. Heat transfer losses are also minimized by spending less time at high temperature using a free piston profile rather than a slider-crank profile. Frictional losses are minimized because the extractor pistons 125 experience lower peak pressures than the free pistons 110. Blow-by losses are minimized by having well-designed piston seals and using gas-linkage gas that contains unburned fuel as part of the intake for the next combustion cycle.

The embodiment of FIGS. 7 and 8 describes in detail the physical and operational characteristics of one configuration—a two-free piston, two-extractor piston, two-crank, two-stroke embodiment. The following embodiments present several alternative engine configurations. The illustrated embodiments are not meant to be limiting. Other embodiments may be utilized, and other changes may be made, without departing from the scope of the invention. Unless otherwise stated, the physical and operational characteristics of the embodiments described in the following embodiments are the same as those described in the embodiment of FIGS.

7 and 8. Furthermore, all embodiments may be configured in parallel (i.e., in multiple-unit configurations for scaling up) as described above.

Figure 9:
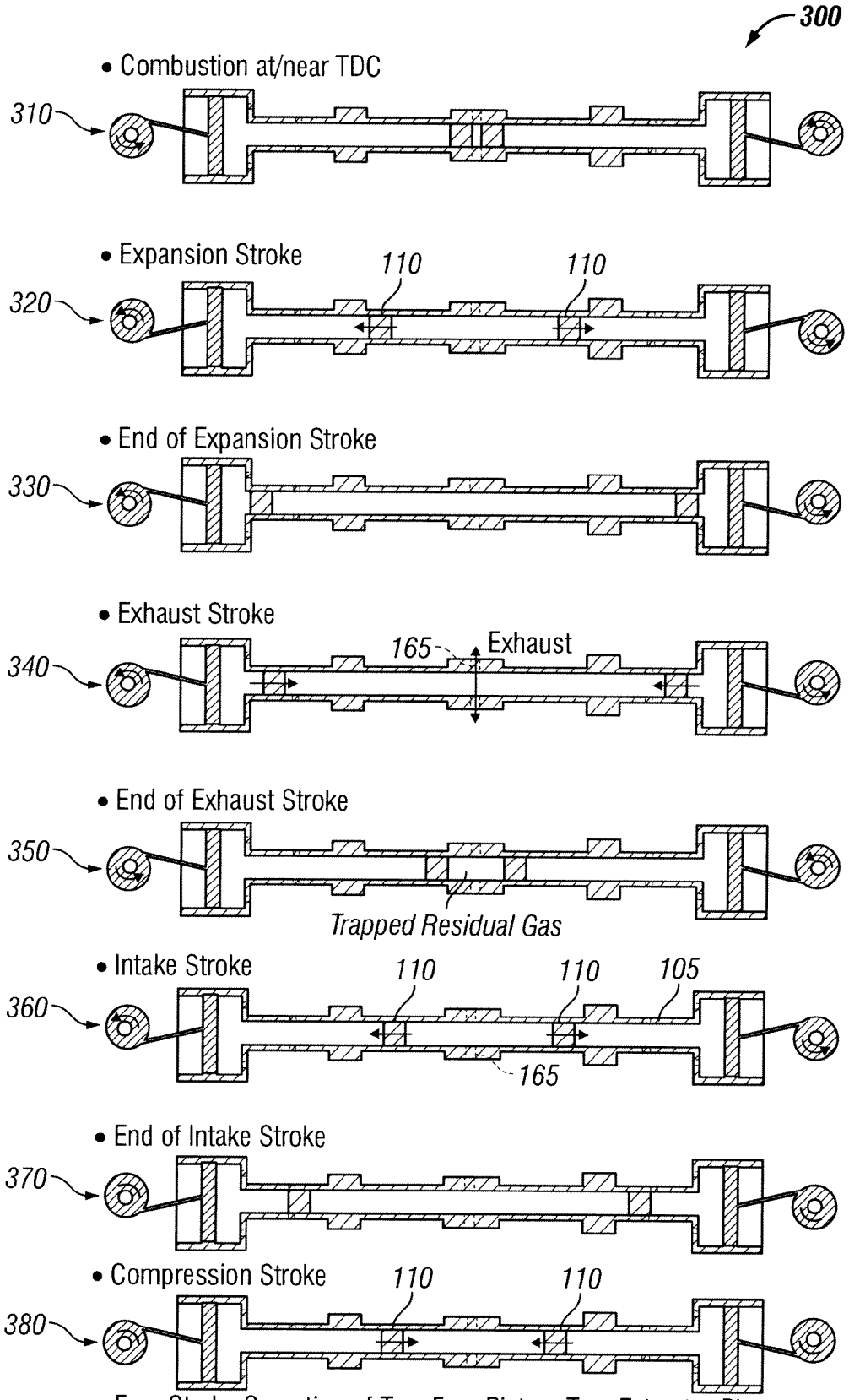
FIG. 9 illustrates a four-stroke piston cycle of the two-free piston, two-extractor piston, two-crank embodiment of FIG. 7, in accordance with the principles of the invention.

FIG. 9 illustrates a four-stroke piston cycle 300 of the two-free piston, two-extractor piston, two-crank engine 100 of FIG. 7. The main physical difference between the four-stroke and two-stroke piston cycles is that the exhaust, injector, and intake ports 165 are located at and/or near the center of the cylinder 105 between the two free pistons 110.

The four-stroke piston cycle 300 is characterized as having a power (expansion) stroke 320, an exhaust stroke 340, an intake stroke 360, and a compression stroke 380. A power stroke 320 begins following combustion 310, which occurs at the optimal volume, and continues until the velocities of the pistons 110 are zero, which mark their expansion-BDC positions for that cycle. At and near the expansion-BDC point 330, the pressure of the gas in the gas linkage 120 is greater than the pressure of the gas in the combustion section 115, which forces the pistons 110 inwards. The gas in the gas linkage 120 is used to provide at least some of the energy required to perform an exhaust stroke 340. Exhaust ports 165 open at some point at or near the expansion-BDC, which can be before or after an exhaust stroke 340 begins. An exhaust stroke 340 continues until the velocities of the pistons 110 are zero, which marks their exhaust-TDC positions for that cycle. Exhaust ports 165 close at some point before the pistons 110 reach their exhaust-TDC positions 350. Therefore, at least some combustion products remain in the combustion section 115. This process is referred to as "residual gas trapping".

At and/or near the exhaust-TDC, the pressure of the combustion section 115 is greater than the pressure of the gas linkage 120, which forces the pistons 110 outwards. The trapped residual gas acts as a gas spring to provide at least some of the energy required to perform an intake stroke 360. Intake ports 165 open at some point during the intake stroke 360 after the pressure within the combustion section 115 is below the pressure of the intake gas. An intake stroke 360 continues until the velocities of the pistons 110 are zero, which marks their intake-BDC positions 370 for that cycle. The intake-BDC positions for a given cycle do not necessarily have to be the same as the expansion-BDC positions. Intake ports 165 close at some point at or near intake-BDC. At and/or near the intake-BDC position, the pressure of the gas in the gas linkage 120 is greater than the pressure of the gas in the combustion section 115, which forces the pistons 110 inwards and compresses the gas in the combustion section 115. This is the compression stroke 380, which continues until combustion 310 occurs when the velocities of the pistons 110 are at or near zero. The positions of the pistons 110 at which their velocities equal zero mark their compression-TDC positions for that cycle.

As in the two-stroke piston cycle, work is extracted from engine 300 through the extractor pistons 125. In this embodiment, the extractor pistons 125 are connected to crank shafts 135 that have flywheels 140. The free pistons 110 and extractor pistons 125 are phased such that the indicated work in the combustion section 115 is equal to the sum of the indicated work in the gas linkage 120 for a given engine geometry for each cycle. Optimal phasing is maintained and controlled through a direct or indirect application of force to the free piston 110, fuel amount, and/or through the exchange of gas to and from the gas linkage 120. The system may directly apply force to the free pistons 110 via physical contact and/or indirectly apply force via electromagnetic communication. Force may be applied at multiple points along the cylinder 105. Gas exchange with the gas linkage 120 may occur at various points within a cycle. The controller 150 may adjust the force application, fuel amount, and/or gas exchange to achieve appropriate work extraction, efficiency and safety.

Figure 10:
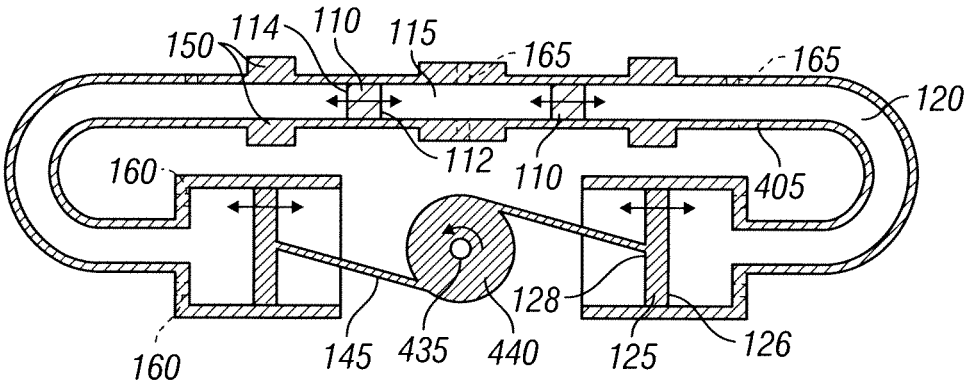
FIG. 10 illustrates a two-free piston, two-extractor piston, single-crank, two-stroke embodiment that is similar to the embodiment shown in FIG. 7, but with a both extractor pistons connected to a single crankshaft, in accordance with the principles of the invention.

FIG. 10 illustrates a two-free piston, two-extractor piston, single-crank, two-stroke engine 400 that is similar in many ways to the engine 100 of FIG. 7, wherein like elements have been labeled accordingly. The main structural distinctions are that the cylinder 105 of FIG. 7 is replaced with a cylinder with curved ends 405 that forms curvilinear path or track, such that both extractor pistons 145 are connected to a single crankshaft 435 and flywheel 440. Accordingly, only one crankshaft 435, flywheel 440, and rotary generator is required per unit, thereby reducing capital cost. This embodiment has all of the same operating characteristics as those discussed above with respect to the embodiment of FIG. 7. Additionally, this single-crank engine 400 can also operate using a four-stroke piston cycle.

Figure 11:
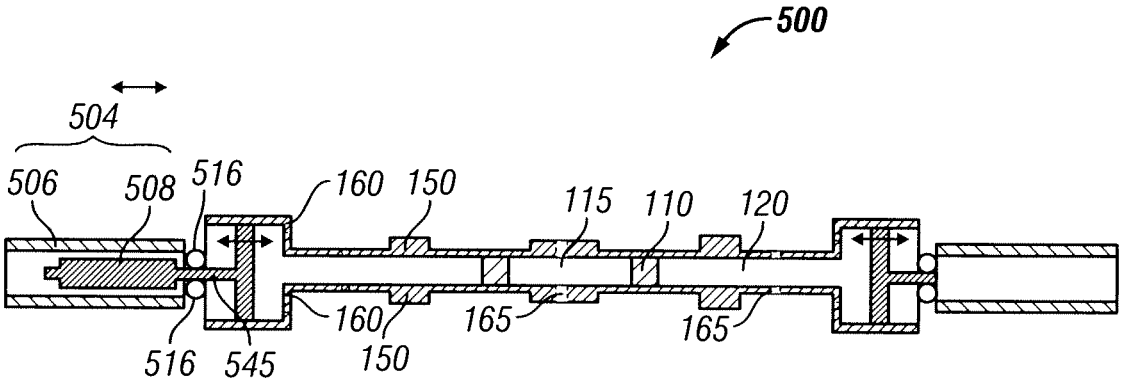
FIG. 11 illustrates a two-free piston, two-extractor piston embodiment that utilizes two linear electromagnetic machines to convert the kinetic energy of the extractor pistons to electrical energy, in accordance with the principles of the invention.

FIG. 11 illustrates a two-free piston, two-extractor piston engine 500 that is similar in many ways to the engine 100 of FIG. 7, wherein like elements have been labeled accordingly. One structural difference is the engine 500 utilizes two linear electromagnetic machines (LEMs) 504 to convert the kinetic energy of the extractor pistons 125 to electrical energy, instead of the crankshaft/rotary generator combination described in the previous embodiments of FIG. 7 and FIG. 10. Each LEM 504 comprises a stator 506 and a translator 508. Another structural distinction involves the use of linear bearings 516 for the connecting/piston rod 545. As used herein, the term "bearing" refers to any part of a machine on which another part moves, slides, or rotates, including but not limited to slide bearings, flexure bearings, ball bearings, roller bearings, gas bearings, or magnetic bearings.

With continued reference to FIG. 11, the piston rods 545 move along the bearings 520 and are sealed from the surroundings by gas seals that are fixed to the cylinder. The only operational difference of this embodiment involves the manner in which the motion, or kinetic energy, of the connecting rod 545 is converted into electrical energy. In previous embodiments, a slider-crank mechanism is employed to convert the linear motion of the extractor piston to rotary motion, which can then be converted to electrical energy using an off-shelf rotary electrical machine. In the embodiment of FIG. 11, the linear motion of each extractor pistons 125 is directly converted into electrical energy through an LEM 504. The LEM 504 is also capable of directly converting electrical energy into kinetic energy of the piston assembly for providing compression work during a compression stroke (similar to a flywheel).

During operation, the translator 508 is attached to the piston rod 545 and moves linearly within the stator 506, which is stationary. The volume between the translator 508 and stator 506 is referred to as the air gap. FIG. 11 depicts one suitable LEM configuration in which the translator 508 is shorter than the stator 506. In other configurations, the translator 508 could be longer than the stator 506, or they could be substantially the same length. By way of example, the LEM 504 may comprise a permanent magnet machine, induction machine, switched reluctance machine, or some combination of the three. The stator 506 and translator 508 can each include magnets, coils, iron, or some combination of the three. Since the LEM 504 directly transforms the kinetic energy of the pistons 545 to and from electrical energy (i.e., there are no mechanical linkages), mechanical and frictional losses have the potential to be less than those in previously described slider-crank embodiments. This embodiment has all of the same operation characteristics as those discussed with respect to the embodiment of FIG. 7, and can also operate using a four-stroke piston cycle.

Figure 12:
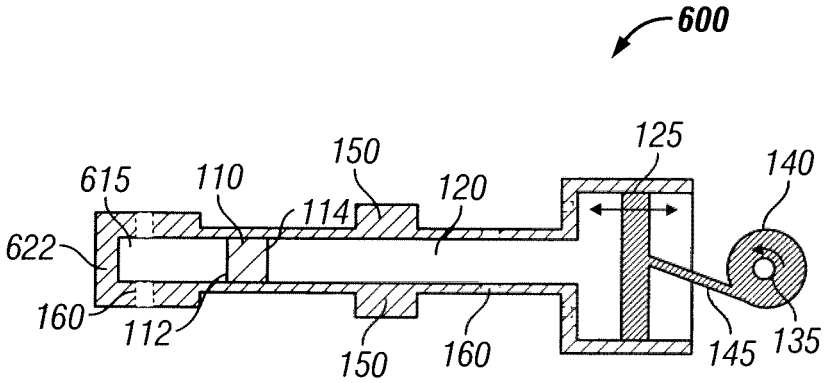
FIG. 12 illustrates a single-free piston, single-extractor piston, single-crank, two-stroke embodiment, in accordance with the principles of the invention.
Figure 13:
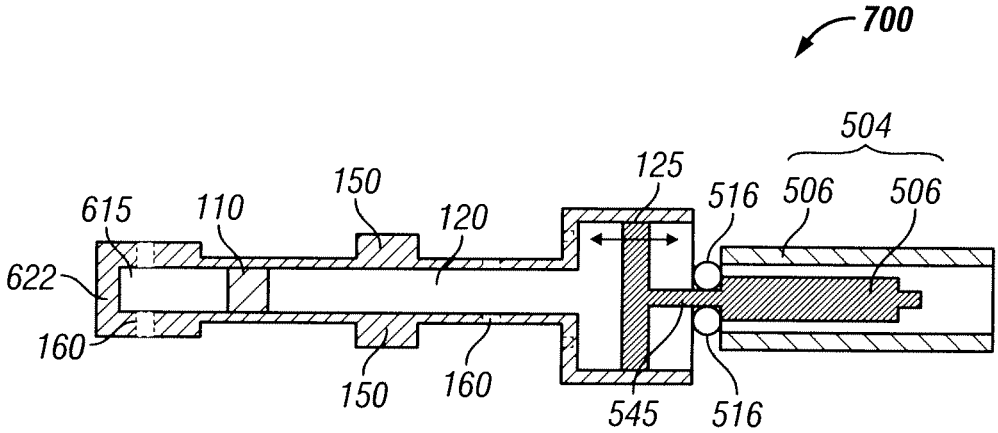
FIG. 13 illustrates a single-free piston, single-extractor piston, single-LEM, two-stroke embodiment, in accordance with the principles of the invention.

FIGS. 12 and 13 illustrate single-free piston, single-extractor piston embodiments of those shown in FIG. 7 and FIG. 11, respectively. In particular, FIG. 12 illustrates a single-free piston, single-extractor piston, single-crank, two-stroke engine 600, while FIG. 13 illustrates a single-free piston, single-extractor piston, single-LEM, two-stroke engine 700. All of the previously discussed embodiments include two free pistons 110 forming a combustion section in the center of the cylinder 105, whereas the two embodiments shown in FIG. 12 and FIG. 13 have a single-free piston 110 and the combustion section 615 is formed between the front face 112 of the piston 110 and the closed end 622 of the cylinder (the "head"). Since these embodiments only have one set of free and extractor pistons 110, 125, they only have one electrical machine a crankshaft/rotary electrical machine in FIG. 12 and an LEM 504 in FIG. 13. In addition, these embodiments have a different velocity and acceleration profile than the corresponding two-free piston embodiments as a result of having a single-free piston. However, they still provide the benefit of a free piston profile in that less time is spent at and near TDC than in a conventional, slider-crank, reciprocating engine. Both embodiments share all of the same operation characteristics as those discussed above with respect to the embodiment of FIG. 7, and can also operate using a four-stroke piston cycle.

The embodiments illustrated in FIGS. 7, 10 and 12 extract work through the extractor piston 125 using direct connection via a connecting rod 145 to a crankshaft 135. This is often referred to as a "slider-crank" mechanism. However, the invention is not limited to a slider-crank mechanism, as it is also compatible with other mechanism that convert linear motion to rotary motion, such as, but not limited to, a scotch-yoke mechanisms, rack-and-pinion mechanisms, and four-bar linkage mechanisms.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A free piston combustion engine with indirect work extraction via gas linkage, comprising:

a cylinder with curved ends with two opposed free pistons disposed therein that form a combustion section in a center of the cylinder, each free piston comprising a front face facing the combustion section and a back face facing the opposite direction, wherein the free pistons are free from mechanical linkages external of the cylinder;

two opposed extractor pistons, each extractor piston disposed in its own cylinder at opposite ends of the free piston cylinder, each extractor piston comprising a front face facing the combustion section and a back face facing the opposite direction; and two gas linkages, each gas linkage comprising a volume sealed between the back face of a free piston and the front face of an extractor piston;

wherein each extractor piston is connected to a single rotary electromagnetic machine.

2. The engine of claim 1, wherein the gas linkage acts a gas spring translating forces between two moving pistons without dictating a specific axial separation or a specific volumetric separation.

3. The engine of claim 1, wherein the force on the front face of an extractor piston is directly converted into rotary motion, which is then converted to electrical energy through the rotary electromagnetic machine.

4. The engine of claim 1, wherein the rotary electromagnetic machine comprises a permanent magnet machine, induction machine, switched reluctance machine, or a combination thereof.

5. The engine of claim 1, further comprising a device for indirectly applying a force to the free pistons in order to adjust piston velocity and phasing to selected values.

6. The engine of claim 1, wherein the engine operates using a two-stroke piston cycle including a power stroke and a compression stroke, with an expansion ratio greater than a compression ratio, wherein combustion occurs after the compression stroke when the velocities of the free pistons are at or near zero.

7. The engine of claim 1, wherein the engine operates using a four-stroke piston cycle including a power stroke, an exhaust stroke, an intake stroke, and a compression stroke, with an expansion ratio greater than the compression ratio, wherein combustion occurs after a compression stroke when the velocities of the free pistons are at or near zero.

8. The engine of claim 1, wherein:

fuel is directly injected into the combustion section via fuel injectors or is mixed with air prior to or during air intake; and the engine is capable of operation with lean, stoichiometric, or rich combustion using liquid or gaseous fuels.

9. The engine of claim 1, further comprising:

one or more exhaust/injector ports that allow exhaust gases and fluids to enter and leave the free piston cylinder;

one or more intake ports that allow the intake of air or air/fuel mixtures or air/fuel/combustion product mixtures;

one or more driver gas removal ports that allow for the removal of driver gas;

and one or more driver gas make-up ports that allow for the intake of make-up gas for the driver section.

10. The engine in claim 1, wherein combustion products from a previous cycle can be mixed with intake air and/or an intake air/fuel mixture prior to or during a compression stroke.

11. The engine of claim 1, wherein:

engine ignition is achieved via compression ignition; and optimal combustion is achieved by moderating the gas temperature within the combustion section such that it reaches its auto-ignition temperature at its optimal volume.

12. The engine of claim 1, wherein:

engine ignition is achieved via spark ignition; and optimal combustion is achieved by moderating the gas temperature within the combustion section such that it remains below its auto-ignition temperature before a spark fires at optimal volume.

13. A linear free piston combustion engine with indirect work extraction via gas linkage, comprising:

a cylinder having a combustion section located at a closed end of the cylinder;

a free piston disposed within the cylinder, the free piston comprising a front face facing the combustion section and a back face facing the opposite direction, wherein the free piston is free from mechanical linkages external of the cylinder;

an extractor piston disposed in its own cylinder at an end of the cylinder opposite the closed end, the extractor piston comprising a front face facing the combustion section and a back face facing the opposite direction; and a gas linkage comprising a volume sealed between the back face of the free piston and the front face of the extractor piston;

wherein the extractor piston is connected to a rotary electromagnetic machine without an intervening turbine.

14. The engine of claim 13, wherein the force on the front face of the extractor piston is directly converted into rotary motion, which is then converted to electrical energy through the rotary electromagnetic machine.

15. The engine of claim 13, wherein the rotary electromagnetic machine comprises a permanent magnet machine, induction machine, switched reluctance machine, or a combination thereof.

16. The engine of claim 13, wherein the engine operates using a four-stroke piston cycle including a power stroke, an exhaust stroke, an intake stroke, and a compression stroke.

17. The engine of claim 13, wherein the gas linkage acts a gas spring translating forces between two moving pistons without dictating a specific axial separation or a specific volumetric separation.

18. The engine of claim 13, further comprising a device for indirectly applying a force to the free pistons in order to adjust piston velocity and phasing to selected values.

19. The engine of claim 13, wherein the engine operates using a two-stroke piston cycle including a power stroke and a compression stroke, with an expansion ratio greater than a compression ratio, wherein combustion occurs after the compression stroke when the velocities of the free pistons are at or near zero.

20. The engine of claim 13, wherein the engine operates using a four-stroke piston cycle including a power stroke, an exhaust stroke, an intake stroke, and a compression stroke, with an expansion ratio greater than the compression ratio, wherein combustion occurs after a compression stroke when the velocities of the free pistons are at or near zero.

21. The engine of claim 13, wherein:

fuel is directly injected into the combustion section via fuel injectors or is mixed with air prior to or during air intake; and the engine is capable of operation with lean, stoichiometric, or rich combustion using liquid or gaseous fuels.

22. The engine of claim 13, further comprising:

one or more exhaust/injector ports that allow exhaust gases and fluids to enter and leave the free piston cylinder;

one or more intake ports that allow the intake of air or air/fuel mixtures or air/fuel/combustion product mixtures;

one or more driver gas removal ports that allow for the removal of driver gas;

and one or more driver gas make-up ports that allow for the intake of make-up gas for the driver section.

23. The engine in claim 13, wherein combustion products from a previous cycle can be mixed with intake air and/or an intake air/fuel mixture prior to or during a compression stroke.

24. The engine of claim 13, wherein:

engine ignition is achieved via compression ignition; and optimal combustion is achieved by moderating the gas temperature within the combustion section such that it reaches its auto-ignition temperature at its optimal volume.

25. The engine of claim 13, wherein:

engine ignition is achieved via spark ignition; and optimal combustion is achieved by moderating the gas temperature within the combustion section such that it remains below its auto-ignition temperature before a spark fires at optimal volume.

26. A linear free piston combustion engine, comprising:
a first cylinder comprising a combustion section;
a first piston comprising:
a first front face facing the combustion section, and
a first back face facing an opposite direction to that of the first front face, wherein the first piston is free from mechanical linkages external of the first cylinder;
a second cylinder; and
a second piston disposed in the second cylinder, the second piston coupled to an electromagnetic machine without an intervening turbine and comprising:
a second front face, and
a second back face facing an opposite direction to that of the second front face, wherein
an end of the first cylinder is coupled to an end of the second cylinder to form a gas linkage comprising a volume between the first back face and the second front face.

27. The engine of claim 26, wherein the electromagnetic machine is a first electromagnetic machine, the gas linkage is a first gas linkage, the end of the first cylinder is a first end of the first cylinder, and the volume is a first volume, the engine further comprising:
a third piston comprising:
a third front face facing the combustion section opposite the first front face, and
a third back face facing an opposite direction to that of the third front face,
wherein the third piston is free from mechanical linkages external of the first cylinder;
a third cylinder; and
a fourth piston disposed in the third cylinder, the fourth piston coupled to a second electromagnetic machine without an intervening turbine and comprising:
a fourth front face, and
a fourth back face facing an opposite direction to that of the fourth front face, wherein a second end of the first cylinder is coupled to an end of the third cylinder to form a second gas linkage comprising a second volume between the third back face and the fourth front face.

28. The engine of claim 26, wherein the gas linkage acts as a gas spring translating forces between the first piston and the second piston without dictating a specific axial separation or a specific volumetric separation.

29. The engine of claim 26, wherein the electromagnetic machine is a rotary electromagnetic machine.

30. The engine of claim 29, wherein a force on the second front face is directly converted into rotary motion, which is then converted to electrical energy through the rotary electromagnetic machine.

31. The engine of claim 26, wherein the electromagnetic machine comprises one of a permanent magnet machine, an induction machine, a switched reluctance machine, and any combination thereof.

32. The engine of claim 26, further comprising a device for indirectly applying a force to the first and second pistons in order to adjust piston velocity and phasing to selected values.

33. The engine of claim 26, wherein the engine operates using a two-stroke piston cycle including a power stroke and a compression stroke, with an expansion ratio greater than a compression ratio, wherein combustion occurs after the compression stroke when the velocities of the free pistons are at or near zero.

34. The engine of claim 26, wherein the engine operates using a four-stroke piston cycle including a power stroke, an exhaust stroke, an intake stroke, and a compression stroke, with an expansion ratio greater than the compression ratio, wherein combustion occurs after a compression stroke when the velocities of the free pistons are at or near zero.

35. The engine of claim 26, wherein:
fuel is directly injected into the combustion section via fuel injectors or is mixed with air prior to or during air intake; and
the engine is capable of operation with lean, stoichiometric, or rich combustion using liquid or gaseous fuels.

36. The engine of claim 26, further comprising:
one or more exhaust/injector ports that allow exhaust gases and fluids to enter and leave the first cylinder;
one or more intake ports that allow the intake of air or air/fuel mixtures or air/fuel/combustion product mixtures;
one or more driver gas removal ports that allow for the removal of driver gas; and
one or more driver gas make-up ports that allow for the intake of make-up gas for a driver section.

37. The engine of claim 26, wherein the first cylinder is configured to mix combustion products from a previous cycle with intake air, an intake air/fuel mixture, or both prior to or during a compression stroke.

38. The engine of claim 26, wherein:
engine ignition is achieved via compression ignition; and
optimal combustion is achieved by moderating the gas temperature such that it auto ignites at its optimal volume.

39. The engine of claim 26, wherein:
engine ignition is achieved via spark ignition; and
optimal combustion is achieved by moderating the gas temperature such that it does not auto-ignite before a spark fires at its optimal volume.

40. The engine of claim 26, wherein the electromagnetic machine is a linear electromagnetic machine.

41. The engine of claim 40, wherein the linear electromagnetic machine comprises a stator and a translator.

42. The engine of claim 41, wherein the second piston comprises a piston rod that is attached to the translator.

43. The engine of claim 40, wherein the linear electromagnetic machine is configured to directly convert kinetic energy of second piston into electrical energy during an expansion stroke.

* * * * *